US008038052B2

(12) United States Patent
Huang

(10) Patent No.: US 8,038,052 B2
(45) Date of Patent: Oct. 18, 2011

(54) RETRACTABLE DUAL-PURPOSE FILE FOLDER

(76) Inventor: James C. Huang, Taichung (TW)

( * ) Notice: Subject to any disclaimer, the term of this patent is extended or adjusted under 35 U.S.C. 154(b) by 301 days.

(21) Appl. No.: 12/537,428

(22) Filed: Aug. 7, 2009

(65) Prior Publication Data

US 2011/0031732 A1 Feb. 10, 2011

(51) Int. Cl.
*B65D 37/00* (2006.01)
*B65D 85/00* (2006.01)

(52) U.S. Cl. ..... 229/67.3; 229/67.4; 206/425

(58) Field of Classification Search ..... 229/67.1–67.4, 229/72, 928; 206/425
See application file for complete search history.

(56) References Cited

U.S. PATENT DOCUMENTS 1,553,832 A * 9/1925 Mosher ..... 190/109
1,636,838 A * 7/1927 Roser ..... 190/103
1,940,900 A * 12/1933 Barnard ..... 190/110
4,262,838 A * 4/1981 Mackenzie ..... 229/72
4,919,240 A * 4/1990 Tobias ..... 190/103
5,271,502 A * 12/1993 Chang ..... 206/425
7,147,142 B1 * 12/2006 Chang ..... 229/67.3

* cited by examiner

*Primary Examiner* — Jes F Pascua
(74) *Attorney, Agent, or Firm* — Egbert Law Offices PLLC

(57) ABSTRACT

The present invention provides a retractable dual-purpose file folder, including a retractable chamber with a front panel, a rear panel, a retractable bottom wall, two retractable side walls and an accommodation space. A plurality of three-sided sealed spacers is arranged at intervals into the accommodation space of the retractable chamber, the bottom of which is coupled onto the retractable bottom wall. There is a multi-section locator, including first and second locators. The first locator is arranged onto the front panel, and the second locator arranged on the rear panel. The invention includes positioning bands, each with a positioning end located securely on the front panel and a moveable end with a mating portion mated securely with the first and second locators. The retractable dual-purpose file folder can be accommodated into the brief case and placed uprightly on the table for meeting the diversified customer requirements with better applicability.

3 Claims, 4 Drawing Sheets

RETRACTABLE DUAL-PURPOSE FILE FOLDER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a retractable file folder, and more particularly to an innovative one which can be accommodated into brief case and placed vertically on the table.

2. Description of Related Art Including Information Disclosed Under 37 CFR 1.97 and 37 CFR 1.98

A file folder is currently a best-selling product that is extensively used for accommodating papers and files. In response to diversified customer requirements, novel file folders of various patterns, textures and structural types have been developed in this industry.

The structure of the file folder is considered from different aspects, such as functionality, structural strength, value, user-friendliness, portability and functional classification.

However, some shortcomings of the typical file folder still exist. The file folder can be stretched for accessing the files, or the bottom area of the file folder can be expanded for placing it vertically on the table, but it is difficult to make it smaller or thinner and to place it easily into the brief case due to its inflexibility.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the unique present invention, the retractable dual-purpose file folder mainly comprises the retractable chamber, three-sided sealed spacers, multi-section locator and positioning band. The file folder can be accommodated into the brief case and placed upright on the table for meeting the diversified customer requirements with better applicability.

There are improvements brought about by this invention.

Based on the structure of the present invention, the finger lock hole is set correspondingly onto the front and rear panels of the retractable chamber. Finger buckling is enabled to easily withdraw the front and rear panels so as to expand the space of the retractable chamber.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
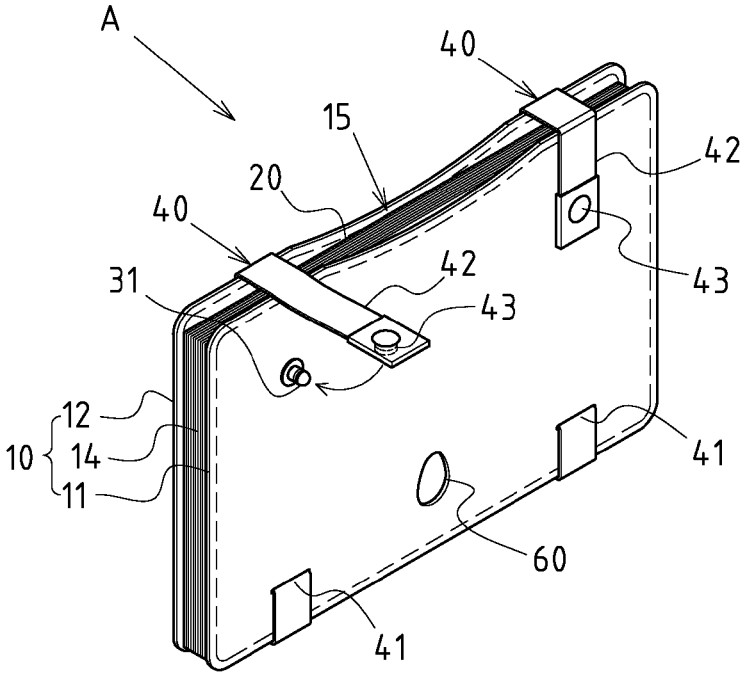
FIG. 1 shows a perspective view of the present invention viewed from the front panel.
Figure 2:
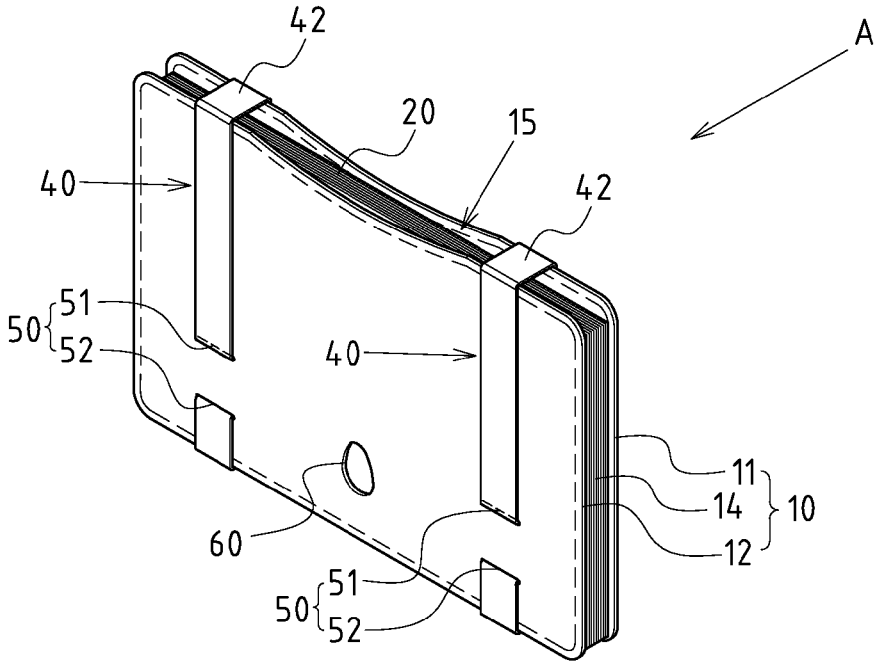
FIG. 2 shows another perspective view of the present invention viewed from the rear panel.
Figure 3:
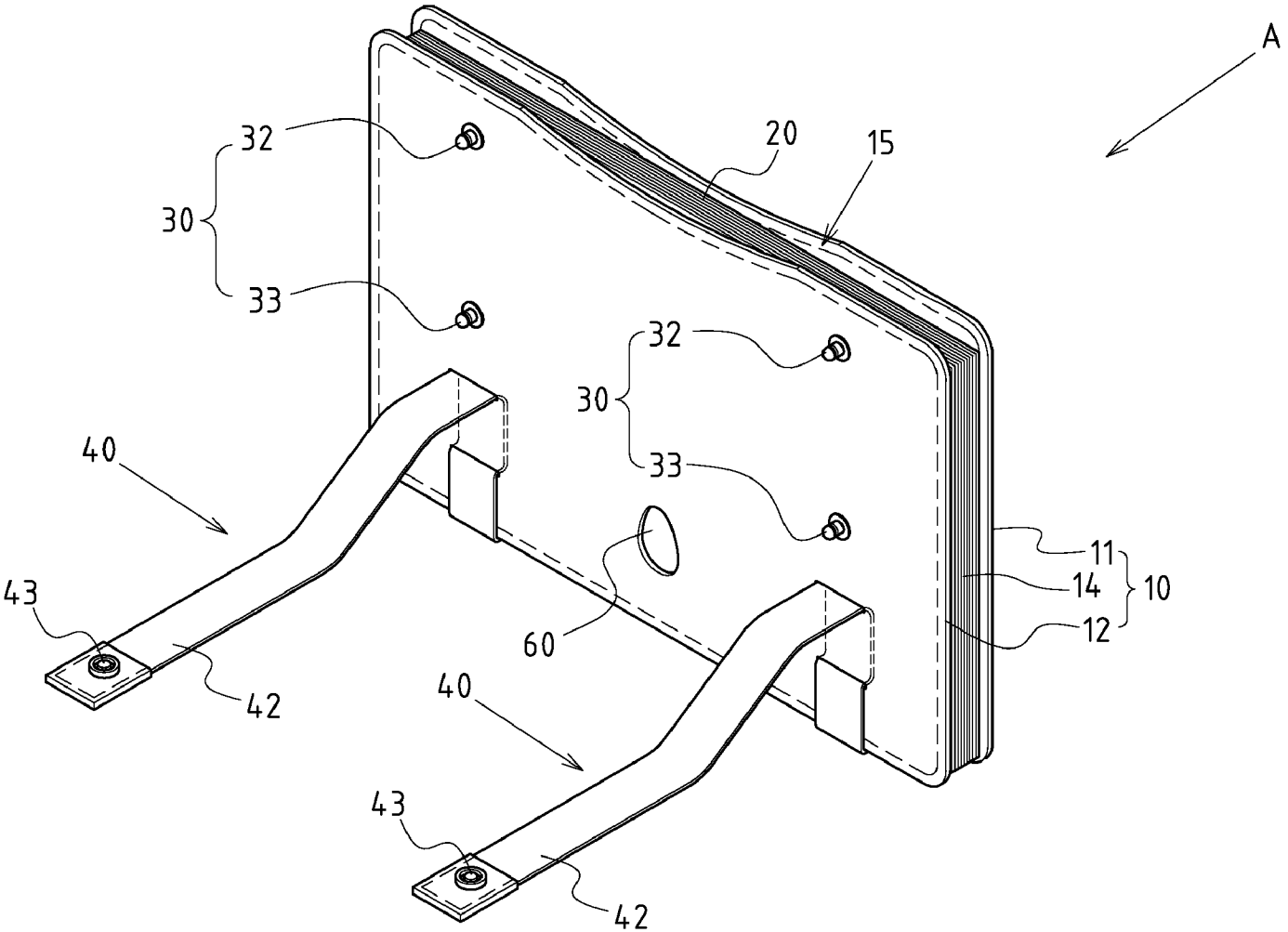
FIG. 3 shows a schematic view of FIG. 2, wherein the moveable end of the positioning band is under a release state.

FIGS. 1-5 depict preferred embodiments of a retractable dual-purpose file folder of the present invention. The embodiments are provided for only explanatory purposes with respect to the patent claims.

The retractable dual-purpose file folder A comprises a retractable chamber 10, including a front panel 11, a rear panel 12, a retractable bottom wall 13, two retractable side walls 14 and an accommodation space 15.

Figure 4:
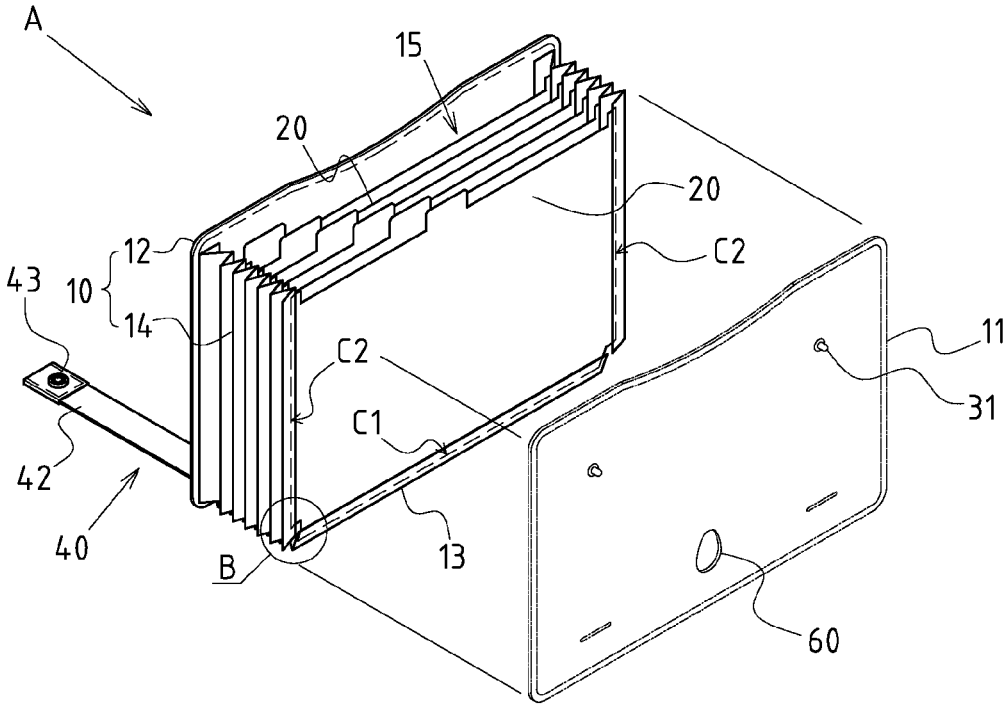
FIG. 4 shows a schematic view of the present invention that the three-sided sealed spacers are linked to the retractable bottom wall and retractable side wall.
Figure 5:
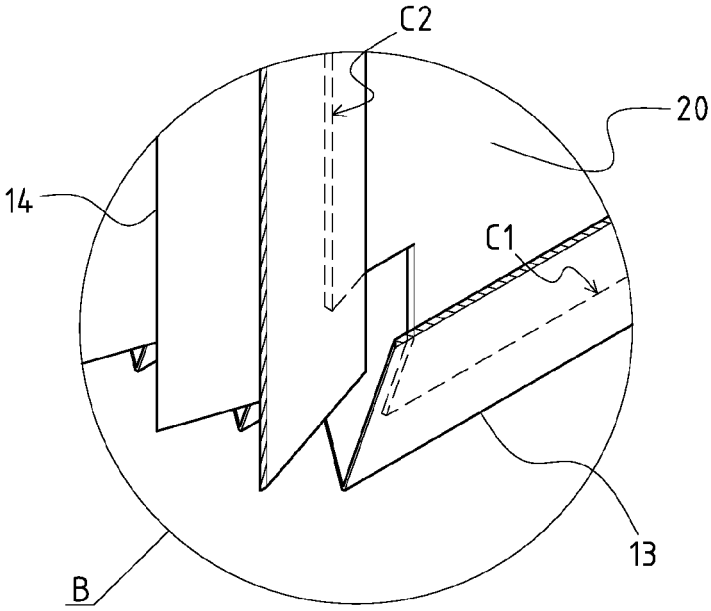
FIG. 5 shows an enlarged schematic view of position B of FIG. 4.

The present invention also comprises a plurality of three-sided sealed spacers 20. Referring to FIGS. 4 and 5, the spacers 20 are arranged at intervals into the accommodation space 15 of the retractable chamber 10. The bottom of the three-sided sealed spacers 20 is coupled onto the retractable bottom wall 13 (shown by C1 of FIGS. 4 and 5), and both sides of the three-sided sealed spacers 20 coupled onto two retractable side walls 14 (shown by C2 of FIGS. 4, 5) for shaping a "three-sided sealing" structure.

At least two multi-section locators 30 include a first locator 31, a second locator 32 and a third locator 33. The first locator 31 is arranged onto the front panel 11 of the retractable chamber 10, while the second locator 32 and third locator 33 are separately arranged at intervals on the upper and lower parts of the rear panel 12 of the retractable chamber 10.

At least two positioning bands 40 are formed by an elongated band. The positioning band 40 includes a positioning end 41 and a moveable end 42. The positioning end 41 is located securely below the first locator 31 specific to the front panel 11 of the retractable chamber 10. A mating portion 43 at the moveable end 42 can be mated securely with the first locator 31, second locator 32 or third locator 33. Moreover, the moveable end 42 is allowed to pass through a band limiting portion 50 preset at lower part of the rear panel 12 of the retractable chamber 10.

The multi-section locator 30 and positioning band 40 are separately arranged at left and right sides of the retractable chamber 10.

The first, second and third locators 31, 32, 33 of the multi-section locator 30 and the mating portion 43 of the moveable end 42 of the positioning band 40 are either of the following members: male/female fastener, male/female adhesive tape, magnetic body and hook.

A finger lock hole 60 is set nearby the bottom of the front panel 11 and rear panel 12 of the retractable chamber 10. With this finger lock hole 60, finger buckling is enabled to withdraw the front and rear panels 11, 12 so as to expand the space of the retractable chamber 10.

Furthermore, the band limiting portion 50 set on the rear panel 12 of the retractable chamber 10 comprises an upper long hole 51 and a lower long hole 52 arranged in parallel. The moveable end 42 of the positioning band 40 can penetrate into the lower long hole 52, then extend upwards and penetrate out of the upper long hole 51, thus realizing proper limitation of the moveable end 42 of the positioning band 40.

Figure 6:
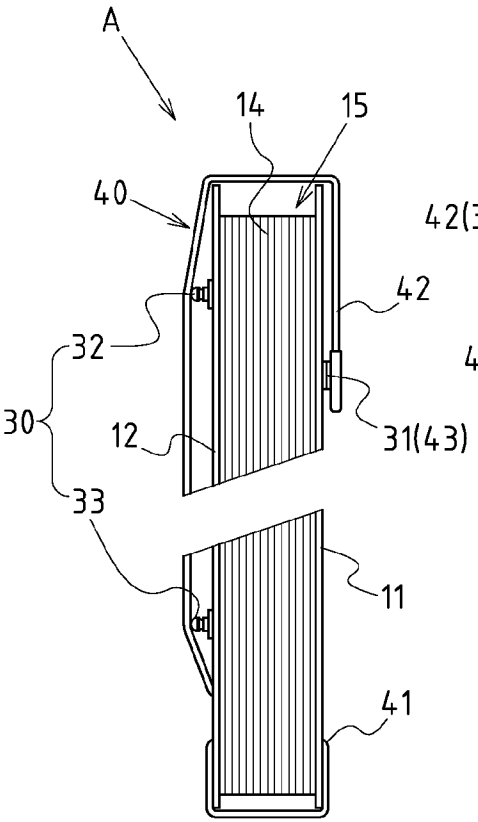
FIG. 6 shows an elevation view of the present invention, showing the retractable chamber under a retracted positioning state.

Based upon above-specified structure, the present invention is operated as follows:

When the retractable dual-purpose file folder A is used, the retractable chamber 10 can be flexibly retracted and expanded, or properly positioned by the positioning band 40. Referring firstly to FIG. 6, when the retractable chamber 10 is under a retracted state, the moveable end 42 of the positioning band 40 has a longest redundant length, so that the mating portion 43 of the moveable end 42 can be extended over the accommodation space 15 and positioned onto the first locator 31 of the front panel 11. In such a case, the upper retraction state of the retractable chamber 10 can be positioned. At the same time, the lower retraction state of the retractable chamber 10 can be positioned by the pressing Ц-shaped section below the moveable end 42 of the positioning band 40. Since the retraction state of the retractable chamber 10 can be positioned, it is possible to minimize the volume and thickness of the retractable dual-purpose file folder A, allowing it to be easily accommodated into the brief case.

Figure 7:
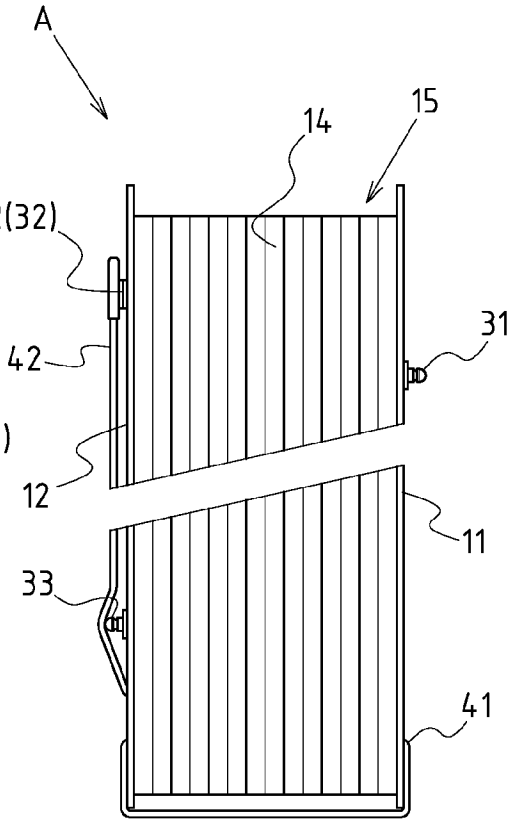
FIG. 7 shows an elevation view of the present invention, showing the first section of the retractable chamber under an expanded positioning state.

Referring to FIG. 7, a schematic view that the first section of the retractable chamber 10 is under an expansion state, wherein the spacing of the front and rear panels 11, 12 is expanded, so that the redundant length of the moveable end 42 of the positioning band 40 is shortened. In such a case, the mating portion 43 of the moveable end 42 will be positioned onto the second locator 32 of the rear panel 12, and the upper opening of the accommodation space 15 is under an open state without being blocked by the positioning band 40. In such a case, the lower expansion state of the retractable chamber 10 can be properly limited by the Ц-shaped section below the moveable end 42 of the positioning band 40. As the bottom area of the retractable chamber 10 is expanded along with the limitation of the positioning band 40, the retractable chamber 10 can be placed stably and uprightly on the table.

Figure 8:
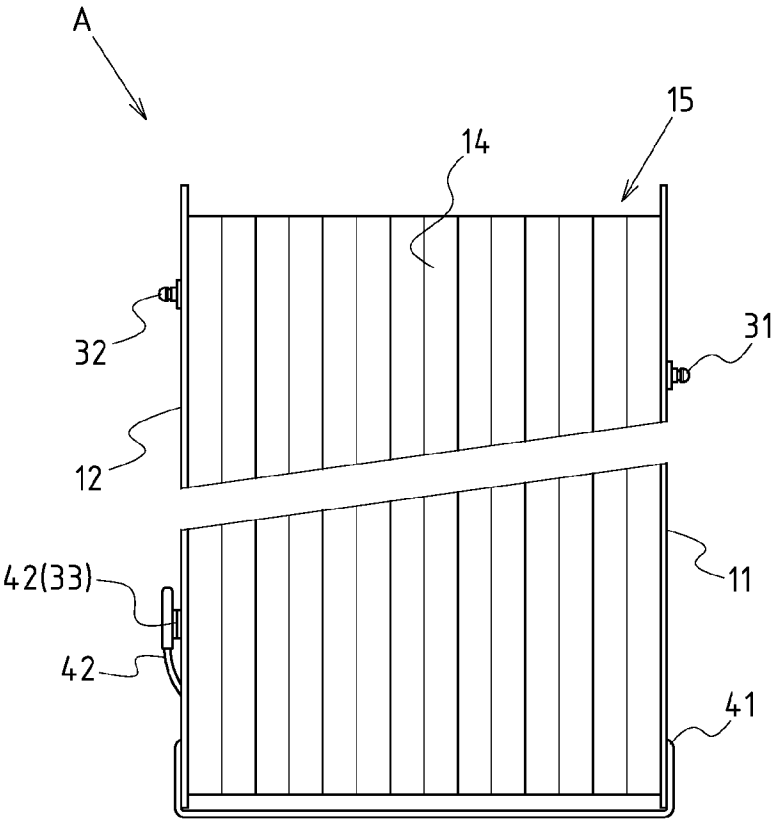
FIG. 8 shows an elevation view of the present invention, showing the second section of the retractable chamber under an expanded positioning state.

Referring to FIG. 8, there is a schematic view, showing the second section of the retractable chamber 10 under an expansion state. The spacing of the front and rear panels 11, 12 is further expanded, so that the redundant length of the moveable end 42 of the positioning band 40 is further shortened. In such a case, the mating portion 43 of the moveable end 42 will be positioned onto the third locator 33 of the rear panel 12, and the lower expansion state of the retractable chamber 10 can still be limited properly by the Ц-shaped section below the moveable end 42 of the positioning band 40.

I claim:

1. A retractable dual-purpose file folder, comprising:

a retractable chamber, comprising a front panel, a rear panel, a retractable bottom wall, two retractable side walls and an accommodation space;

a plurality of three-sided sealed spacers, arranged at intervals into the accommodation space of the retractable chamber, a bottom of the three-sided sealed spacers being coupled onto the retractable bottom wall, both sides of the three-sided sealed spacers being coupled onto two retractable side walls;

at least two multi-section locators, being comprised of a first locator and a second locator, said first locator arranged onto the front panel of the retractable chamber, said second locator arranged on the rear panel of the retractable chamber;

at least two positioning bands formed by an elongated band, each positioning band having a positioning end and a moveable end, each positioning end located securely below the first locator specific to the front panel of the retractable chamber, each moveable end having a mating portion at the moveable mated securely with the first and second locators, the moveable end passing through a band limiting portion preset at lower part of the rear panel of the retractable chamber, said band limiting portion comprising an upper long hole and a lower long hole arranged in parallel.

2. The file folder defined in claim 1, wherein the first and second locators of the multi-section locator and the mating portion of the moveable end of the positioning band are selected from a group consisting of: male/female fastener, male/female adhesive tape, magnetic body and hook.

3. The file folder defined in claim 1, further comprising:

a finger lock hole set correspondingly nearby the bottom of the front and rear panels of the retractable chamber, finger buckling being enabled to easily withdraw the front and rear panels.

* * * * *